United States Patent [19]

Hormann

[11] Patent Number: 4,480,863

[45] Date of Patent: Nov. 6, 1984

[54] DOOR WITH LOCKING DEVICE

[75] Inventor: Michael Hormann, Steinhagen, Fed. Rep. of Germany

[73] Assignee: Hofmann KG Brockhagen, Fed. Rep. of Germany

[21] Appl. No.: 414,839

[22] Filed: Sep. 3, 1982

[30] Foreign Application Priority Data

Sep. 7, 1981 [DE] Fed. Rep. of Germany ..... 3135401

[51] Int. Cl.[3] ..... E05C 3/16

[52] U.S. Cl. ..... 292/216; 292/207; 292/244; 70/DIG. 11

[58] Field of Search ..... 292/244, 216, 207, 208; 49/395, 449; 70/DIG. 11

[56] References Cited

U.S. PATENT DOCUMENTS

| | | | |
|---|---|---|---|
| 1,909,697 | 5/1933 | MacBeth et al. | 49/395 X |
| 1,912,829 | 6/1933 | Crume | 70/DIG. 11 |
| 2,309,437 | 1/1943 | Blodgett | 70/DIG. 11 |
| 2,795,448 | 6/1957 | Johnson | 292/216 |
| 3,506,292 | 4/1970 | Hagendoorn et al. | 292/216 X |
| 4,051,960 | 10/1977 | Raksanyi | 292/216 X |

*Primary Examiner*—Thomas J. Holko
*Assistant Examiner*—Thomas J. Dubnicka
*Attorney, Agent, or Firm*—Robert S. Lipton

[57] ABSTRACT

A latch assembly for use in combination with slidable doors is disclosed. A rotatable disk is connected to the door so that the plane of the disk is perpendicular to the door and parallel to the direction of door movement. A lock bolt which projects from the door jam is adapted to engage a slot in the disk as the door closes, causing the disk to rotate. As the disk rotates, it slides with respect to a spring loaded latch bolt until the bolt slides through a second slot in the disk, when the door is fully closed. Efforts to effectuate a forced entry of the door cause the resulting forces to be passed primarily between the disk and the lock bolt, while the latch bolt's primary function is to prevent rotation of the disk. Thus, an attempted forced entry will not cause excessive forces to be placed on the latch bolt. The latch bolt is slidably connected to a conventional manually operated garage door handle assembly including a lock.

7 Claims, 7 Drawing Figures

Fig. 4
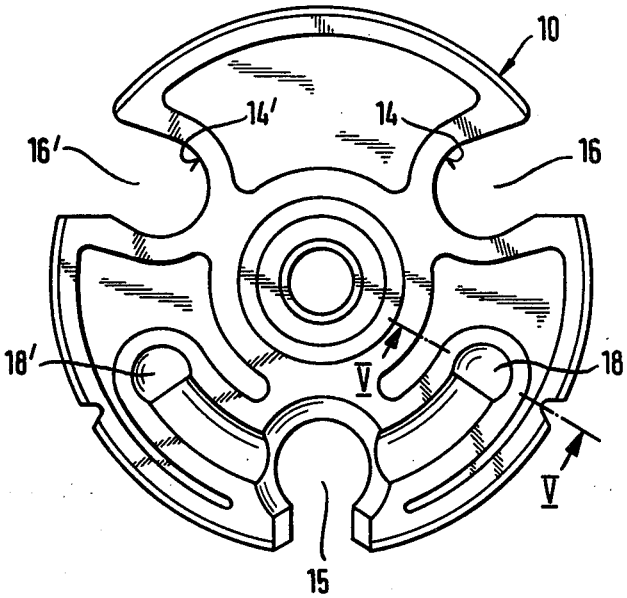
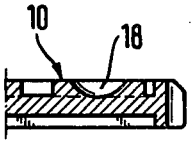
Fig. 5
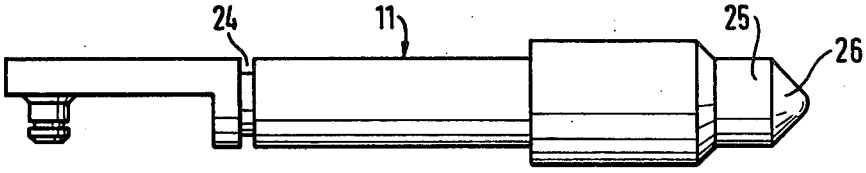
Fig. 6

DOOR WITH LOCKING DEVICE

BACKGROUND OF THE INVENTION

This invention relates to latch and lock mechanisms for movable doors in general, and sliding doors in particular. The invention was designed with slidable overhead garage doors in mind.

Many prior art garage doors are equipped with a lock which has a handle. Rotation of the handle controls latching or locking devices located at the sides of the doors via lock bars. It is also well known that many of these prior art locking devices are equipped with spring loaded latch catches and similar devices, so that the handle and lock can be placed in their closed position while the door is still opened. Upon the actual closing of the door, the side mounted latch catches are released, thus securing the door.

Many prior art doors, particularly those which are used to close large openings, have a great deal of play between the door and the tracks or rails upon which they slide. Such play has, in part, been necessary and, in part, been the result of a desire to keep the cost of such doors low. This has been especially true with respect to slidable overhead garage doors. Of course, the movable metal rods and the stationary members which receive the rods, and which make up the latch mechanisms, are also subject to such play. The play permits the door panel to be moved a certain extent if a force of an appropriate intensity is applied to the door, as during an attempted break-in. Sideway movement creates the risk of the side mounted latch mechanism becoming ineffective and, in fact, unlocked, even when the door mounted lock itself is in the locked position. Extreme shifting movement of the door can be achieved through a rythmic application of force, resulting in a resonant build-up of movement of the door panel. Even if the side mounted latch mechanism can structurally withstand such forces, the forces may cause the operative latch member to move, thus permitting the door to be opened.

SUMMARY OF THE INVENTION

It is an object of the present invention to provide a latch assembly for use in conjunction with sliding doors, which cannot become unlocked by a movement of the door.

It is another object of the present invention to provide such a latch assembly which is inexpensive to manufacture, uncomplicated in design, and easy to install.

In accordance with the present invention, the latch device and lock member are separated. The latch function is accomplished by a spring loaded latch bolt. The locking function is accomplished by a lock bolt. The latch bolt and lock bolt cooperate with a common locking member. Accordingly, when the door is closed and locked, forces exerted during an attempted forced opening of the door will not cause the latch bolt to be forced into opening.

The lock member which the latch bolt and lock bolt cooperate with, is designed in the form of a rotatable lock disk. The disk has two openings in its periphery. One is a slot adapted to receive the lock bolt, while the other opening is adapted to receive the latch bolt. When the door is closed, the disk engages the lock bolt in such a way that the lock bolt is unable to slip out of its slot in the disk. The lock member or disk is held in this particular rotary position by the spring loaded latch bolt, which passes through the disk.

In order to open the door, movement of the door handle causes axial movment of the latch bolt against its spring, thereby withdrawing it from the lock disk. Withdrawal of the lock disk permits rotary motion of the disk. Actual movement of the door causes a force to be exerted between the lock bolt and the disk, causing rotation of the disk and permitting the lock bolt to slip out of the slot in the disk as the door is raised. Due to frictional engagement with its support structure, the disk is prevented from further rotation, thus maintaining it in the proper position to receive the lock bolt when the door is subsequently closed. When the door is closed, the lock bolt will enter its slot in the disk, causing the disk to rotate as the door is closed. Upon full closure of the door, the second slot in the disk will be properly aligned so that the latch bolt may be inserted through it. Since the latch bolt is spring loaded, this will occur automatically if the door handle has been placed in the closed position.

The present invention has been adapted so that, from the operators point of view, the door could be locked prior to closing, so that the locking action occurs automatically upon closing of the door. This occurs due to the fact that the latch bolt is spring loaded. When the manually operated member is turned in the closed or locked position, the spring bolt is released so that it is forced against the disk. Since the disk is now in its opened position, the lock bolt rests against the side of the disk.

In the preferred embodiment of the present invention, the disk is provided with a detent into which the spring loaded latch bolt snaps, when the disk is in its open position. The disk is consequently held in its open position by the spring loaded latch bolt. When a force is exerted on the disk by the shutting of the door, the disk is turned or rotated by the force so that the latch bolt is moved from its detent. The tip of the latch bolt and the detent are appropriately rounded so that the force which is necessary to cause disk rotation is not excessive. Through this preferred design, the force exerted by the spring loaded latch bolt is utilized both for engaging the disk and for maintaining the disk in its open position.

Unlike prior art devices, the present invention is required to be installed only on one side of the door. Which side the device is to be installed on will vary upon the requirement of the ultimate user. In order to permit the user to have the option of installing the device on either side of the door, various structural components of the invention have been duplicated. Duplication of various features of the locking disk are recommended for this purpose.

Doors of the type discussed herein are often equipped with electric door openers. It is common for such electric door openers to inherently lock the door and prevent them from being opened by unauthorized persons when the openers are turned off and the door is in the closed position. Use of the present invention is, accordingly, not necessary in this case. It is common for doors having electric door openers to have their locking devices removed so that the door opener will not be broken in the event of accidental closing of the lock. In such cases, if the electric door opener failed, then the conventional latch assembly has to be reactivated or reinstalled. This is not only unduly complicated, but experience has shown that the removed lock or parts thereof are frequently lost. Therefore, the preferred embodiment of the present invention has been designed so that it may be easily and simply disabled in the event it is used in conjunction with a door having an electric door opener. This is achieved through the use of a small plastic sleeve which maintains the latch bolt in a fully withdrawn or opened position. In the event the electric door opener is inoperative, the plastic sleeve is simply removed thereby reactivating the mechanism.

It can also be insured that the electric door opener is disengaged as soon as the door handle is moved manually into its open position. An attachment point for a cable for this purpose is provided on the mechanism in accordance with the present invention.

BRIEF DESCRIPTION OF THE DRAWINGS

The construction of the preferred embodiment, as well as further objects and advantages of the present invention, will become further apparent from the following description when considered with the accompanying drawings in which like numerals refer to like parts wherein:

FIG. 4 shows a side view of the lock disk.

FIG. 5 shows a partial section taken along lines V—V in FIG. 4.

FIG. 6 shows a side view of the latch bolt.

DESCRIPTION OF THE PREFERRED EMBODIMENT

Figure 1:
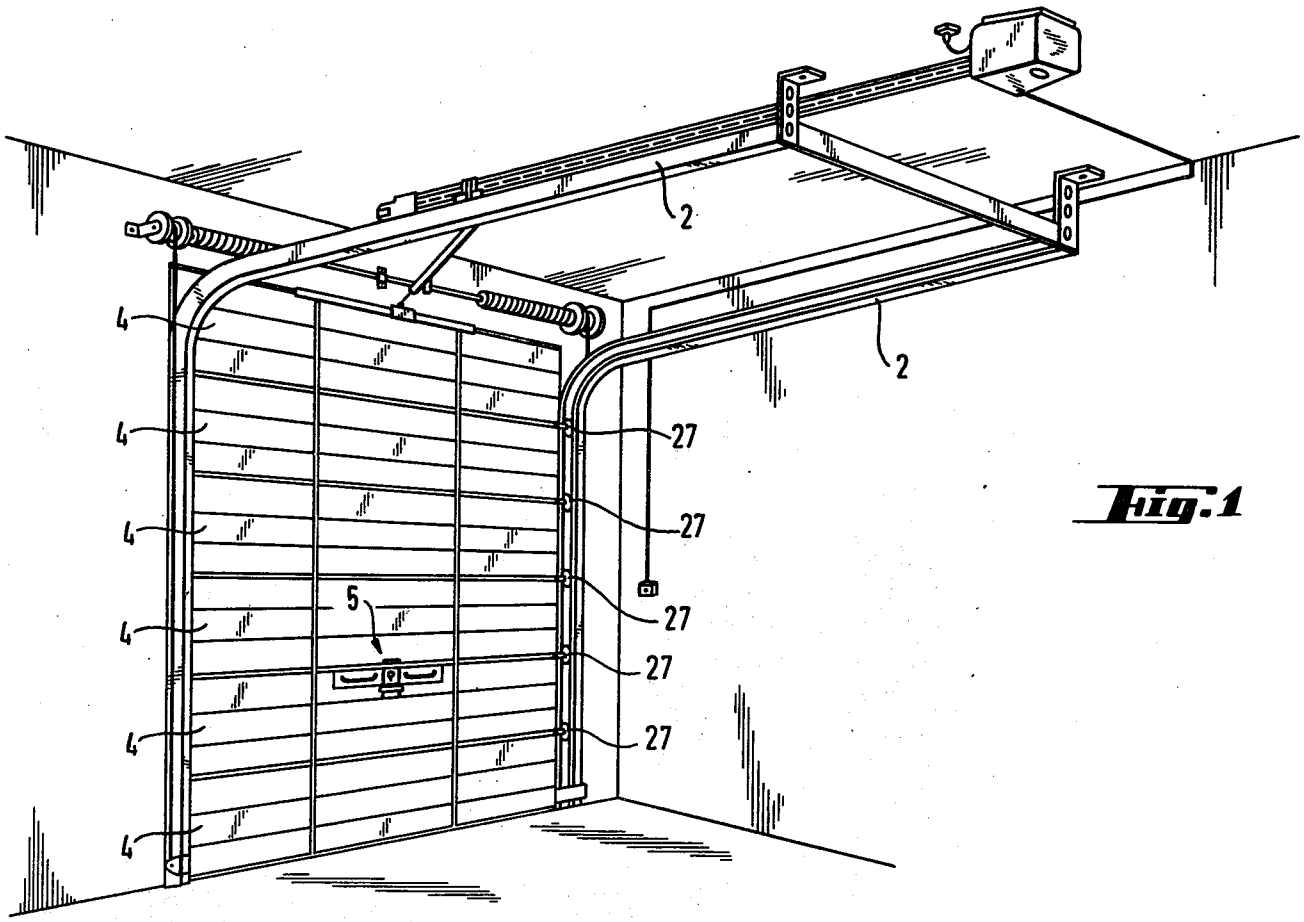
FIG. 1 shows an inside perspective view of a sectional overhead garage door to which the present invention will be applied.
Figure 2:
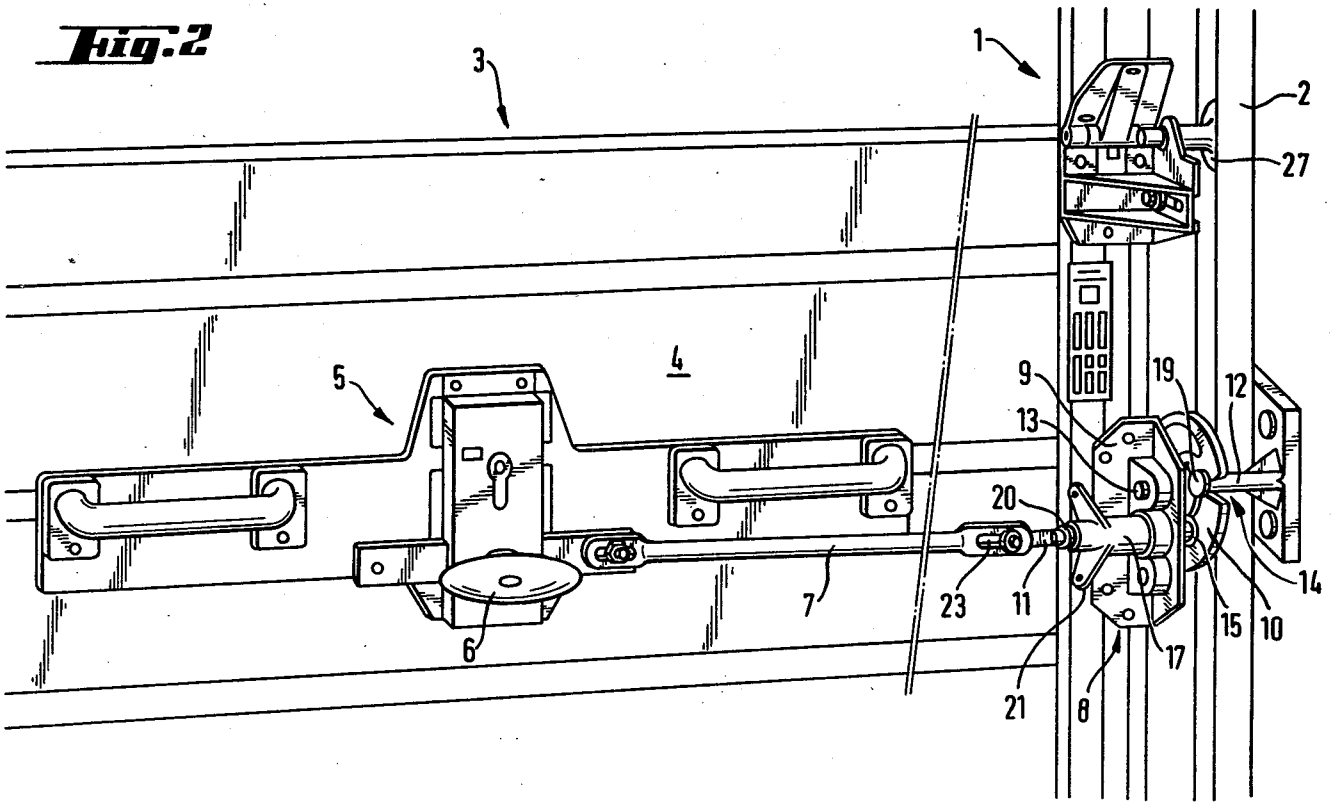
FIG. 2 shows the present invention located on the right side of the door, as viewed from the inside.
Figure 3:
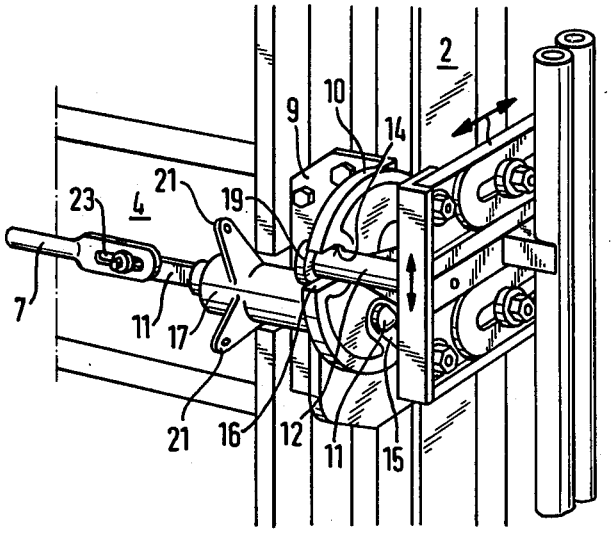
FIG. 3 is a portion of the invention shown in FIG. 2, in greater detail.

FIG. 1 shows a perspective view of a closed door, such as a garage door. The door is made of a number of panels 4 consecutively linked together. The door is mounted for movement on tracks or rails 2, which are generally U-shaped. The door is mounted on the rails 2 by rollers 27 which are connected to the door and which engage the track 2. A lock 5 is mounted on the door in one of the door panels, and will subsequently be discussed in greater detail. As can be seen in FIGS. 2 and 3, the lock mechanism of the present invention is shown being used in combination with the sectional door shown in FIG. 1. The frame 1 includes the two lateral rails or tracks 2 between which the door 3 is mounted. The door 3 includes a number of elementary panels 4 which are arranged one after another and which are linked together. The panels 4 are provided with rollers 27 in the usual manner. The rollers 8*a* engage the guide rails or tracks 2 which guide and support the door over its range of travel. The tracks 2 comprise a vertical section adjacent the opening which is to be closed, a horizontal section which is approximately horizontal to the garage ceiling located above the opening and which supports the door in its open position, and a curved transition region.

A conventional lock 5 is installed on the inside of one of the panels 4 as shown in FIG. 2. The lock 5 includes a handle 6. Rotation of the handle 6 causes linear motion of lock bar 7. The linear or axial motion of lock bar 7 is transmitted to the latch assembly 8. The lock 5 may also include an exterior handle and a conventional key-type lock which may be reached from the outside of the garage.

The latch assembly 8 includes a bracket 9 which is bolted to the edge of one of the panels 4. The latch assembly 8 also includes a disk 10 which is engaged by a latch bolt 11 and lock bolt 12. The disk 10 is mounted to the bracket 9 in such a manner that its axis of rotation 13 is parallel to the panel 4 and perpendicular to the direction of the tracks 2 or to the direction of motion of the door 3.

Figure 7:
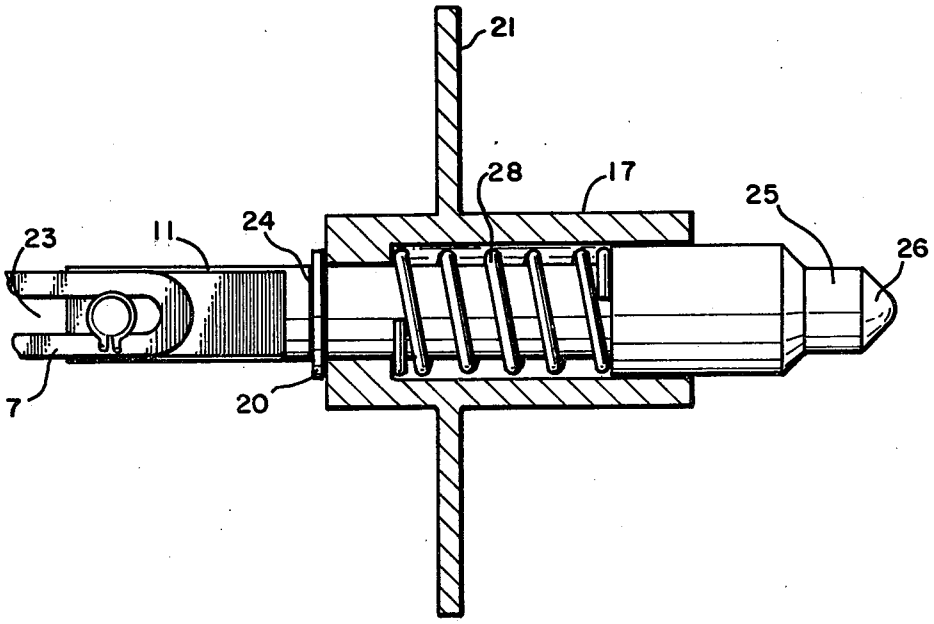
FIG. 7 shows a schematic side view of the latch bolt and guide.

The latch bolt is supported in guide 17 which is connected to the bracket 9 parallel to the disk's axis of rotation 13. The latch bolt 11 is spring mounted within the guide 17 by a spring 28 in a conventional manner as shown in FIG. 7. The latch bolt is spring mounted in such a manner that the latch bolt is forced toward the disk 10. The lock bolt 12, which includes an attachment bracket, is connect to the side of the building or to track 2 by any suitable means. As is shown in FIG. 3, the lock 12 must be properly positioned with respect to the disk 10. During installation, this may be most easily accomplished when the door 3 is in its closed position. As shown by the arrows in FIG. 3, the vertical, and forward and aft position must be appropriately adjusted. The lock bolt 12 is shown behind the center of rotation 13 of disk 10.

In the latch assembly shown, the lock bolt 12 fits into a slot 14 which is provided in the disk 10. The slot 14 has an opening 16 which is directed radially outward. It is through the opening 16 that the locking bolt 12 is able to enter the slot 14 when the door 3 is closed, or to slide out of it when the disk is rotated to its opening position, when the door 3 is opened.

In the latch assembly 8 the latch bolt 11 is adapted to be able to move into an opening 15 in disk 10. When unrestrained, the latch bolt 11 is forced towards the disk and into the opening 15, provided the disk 10 is in the proper position, due to the force of the spring, not shown, which acts on the latch bolt 11 and the guide 17. The lock disk 10 is thus secured in its closed position. The latch bolt 11 prevents the disk from rotating, thereby preventing the lock bolt 12 from slipping out of its slot 14.

In order to open the door 3, the handle 6, or its outside equivalent, must be rotated to the open position. This may require that the lock 5 be unlocked first. Rotation of the handle 6 to its open position, causes the lock bar 7 to move away from the latch assembly 8 by conventional means not shown. Axial movement of lock bar 7 causes the latch bolt 11 to be moved away from disk 10 against the spring which abuts the interior of guide 17. The withdrawal of the latch bolt 11 with respect to guide 17 also causes it to become disengaged or withdrawn from opening 15 in disk 10. Disk 10 is therefore able to rotate when the door 3 is moved upward to its open position. As the door is moved upward, the disk is caused to rotate due to its engagement with stationary lock bolt 12. As the door 3 is opened, disk 10 rotates until it is in its open position and the lock bolt 12 slides out of the slot 14. The disk 10, which is now in its open position, is prevented from rotating further by an appropriate amount of friction between disk 10 and bracket 9. As previously indicated, bracket 9 is rigidly secured to a panel 4 of door 3.

Under certain circumstances it is desirable to place the door latch assembly in a locked position while the door is still open, so that the door will automatically be secured in a locked position when it is closed. This may occur, for example, when the door is to be closed from the outside. In order to accomplish this, the handle 6 of lock 5 is placed in the closed position while the door is still open. This causes lock bar 7 to move toward latch assembly 8, to the right in FIG. 2, thereby releasing the spring loaded latch bolt 11. The latch bolt 11, due to the spring loading, is forced against disk 10 at a point displaced from the opening 15. The lock bar 7 is now able to move with respect to latch bolt 11 due to slot 23 which is formed in the end of lock bar 7, and through which a portion of latch bolt 11 protrudes and is secured to lock bar 7. This enables latch bolt 11 to snap into opening 15 of disk 10 when the disk is appropriately rotated when the door 3 is closed. Thus, the latch assembly 8 is automatically engaged upon the closing o the door 3 without the requirement that the handle 6 or lock bar 7 being moved in the process of activating the latch assembly 8.

Although, as previously indicated, frictional engagement between disk 10 and bracket 9 may be used to prevent the disk from rotating when it is in its open position, additional means may also be used. Such additional means are used in the preferred embodiment of the invention. A recess or detent 18 is formed in disk 10 at the point where latch bolt 11 strikes the disk 10 when the disk is in its open position. The locking means or recess 18 is shown in FIGS. 4 and 5. When the door 3 is in its open position, tip 26 of latch bolt 11 fits into detent 18 of disk 10. It is in this manner that disk 10 is additionally held in the particular rotary position which corresponds to the open position of latch assembly 8, and in which lock bolt 12 is able to enter opening 16 of slot 14 of disk 10 when door 3 is closed. When the door 3 is moved into its closed position, the disk 10 is caused to rotate due to the engagement of the lock bolt 12 so that latch bolt 11 is forced from its position in detent 18 so that it slides along disk 10 until it reaches its fully closed position whereupon latch bolt 11 snaps into the opening 15 which is provided for it.

As may be seen in FIG. 2, lock bolt 12 which faces the door 3, is provided with a head 19. Head 19 is larger in diameter than the width of slot 14. The diameter of opening 14 is thus smaller than the head 19, so the disk 10 cannot be pulled or withdrawn from the bolt 14 by lateral movement of the door parallel to the plane of the door. Thus, the door is secured in the closed position not only against vertical movements of the door 3 in the direction of the tracks 2, but also against sideways movement of the door in a direction parallel to the axis of rotation of the rollers.

It is therefore a particular advantage of the present invention that a single latch assembly 8 is all that is required to secure the door 3 in a closed position. Conventional latch or lock mechanisms are required on both sides of doors of the type discussed herewith.

Since the present device need only be installed on one side of a door, the parts or components which comprise the latch assembly 8 are designed so that they can be mounted on either the left or right side of a door. As may be seen in FIG. 2, the bracket 9 is provided with two fittings, each of which has a hole to receive the disk 10. The holes in the fittings of the bracket are spaced symmetrically with respect to guide 17 which receives latch bolt 11. Disk 10 has a second slot 14' with an opening of 16' for accommodating lock bolt 12, as well as an additional detent 18' for receiving latch bolt 11. As can be seen in FIG. 4, detent 18' and slot 14' are in mere symmetry with respect to detent 18 and slot 14. Of course, the axis of symmetry passes through the center of opening 15 and the axis of rotation 13 of disk 10. When latch assembly 8 is installed on the a side of the door, detent 18' and slot 14' would be used.

As can be seen in FIG. 5, the lock means or recess 18 is designed as a recess into which tip 26, shown in FIG. 6, of latch bolt 11 snaps when the bolt is forced by the spring to press against disk 10 in preparation for passing into opening 15. As can be readily seen, when disk 10 is rotated from this position by bolt 12, end 25 with its tip 26 of latch bolt 11 slides out of the detent 18 under spring tension.

As may be seen in FIG. 6, latch bolt 11 has a groove 24 into which a washer 20 may be inserted as is shown in FIG. 2. The washer 20 limits the movement of latch bolt 11 due to the force of the spring which forces the latch bolt into opening 15 in disk 10 in such a way that tip 26 of end 25 of the latch bolt fits within the opening 15. Thus, twisting forces or forces which tend to rotate disk 10 are incapable of exerting an axial force on latch bolt 11 or the spring which maintains it protruding into opening 15 of disk 10.

When latch bolt 11 is withdrawn from its closed position, as shown in FIG. 2, due to compression of its spring, there will be a space between washer 20 and the face of guide 17. A spacer in the form of a longitudinally split plastic sleeve, not shown, can be inserted in this space, to maintain the latch bolt in its open position even when the handle 6 is turned into the closed position. The latch assembly 8 is thereby deactivated. As previously indicated, this may be desirable when the door 3 is operating with an electric door opener. If, however, it is desired to manually operate the door, the spacer is simply removed, thereby permitting movement of the spring loaded latch bolt, thus causing the latch assembly to resume its normal function, described above.

The present invention may also be adapted to deactivate an electric door opener, if desired, as during a power failure. Projections 21 on guide 17 are provided to hold a cable. Two projections 21 are provided so that this feature may be used when the lock mechanism 8 is installed on either the left or right side of the door 3. The core of the cable is connected to the lock bar. In the event of a power failure, a coupling between the door 3 and the electric door opener, not shown, can also be released by turning handle 6 into its open position. By means of this cable, the door panel 3 can be moved freely by hand rather than being blocked by the stopped electric door opener.

As can be seen in FIG. 4, the opening 16 widens starting from the slot 14 towards the periphery of disk 10, and is in an oblique position relative to the radial direction in order to facilitate the insertion or catching of lock bolt 12, i.e. the center line of opening 14 is not parallel to a disk radial.

Although the present invention has been described with reference to the particular embodiment herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

What is claimed is:

1. In a door assembly of the type having a track which is connected to a building, and a door which is mounted on said track, a latch assembly for securing the door to the building, which comprises: a rotatable disk having an axis of rotation perpendicular to the track and parallel to the plane of the door, said disk having first and second openings about its periphery, said disk being connected to the door; a lock bolt connected to the building which is adapted to be received by said first opening when the door is closed; a latch bolt which is adapted to be received by said second opening when the door and disk are in their closed position; whereby said disk is caused to rotate by said lock bolt when said latch bolt is withdrawn from said second opening; and wherein said latch bolt and said lock bolt are substantially parallel to the axis of rotation of said disk.

2. The apparatus of claim 1 wherein said disk is connected to the door by a bracket assembly connected to the edge of the door, said bracket assembly including a guide having mounted thereto said latch bolt, said latch bolt being slidably engaged to said guide, said guide including a casing for a spring to push said latch bolt toward said disk.

3. The apparatus of claim 2 wherein said disk includes a lock means for engaging said latch bolt when said disk is in its open position thereby maintaining said first opening in a position to engage said lock bolt when the door is closed.

4. The apparatus of claim 3 wherein said disk is provided with two of said first openings and two of said locking means, thereby permitting said latch assembly to be installed on the opposite side of the door.

5. The apparatus of claim 4 wherein said bracket is provided with two means for rotatably connecting said disk to said bracket, thereby permitting said bracket to be mounted on the opposite side of the door.

6. The apparatus of claim 5 which further includes a disabling means for maintaining said latch mechanism to be rendered inoperable.

7. The apparatus of claim 6 wherein said bracket includes a connection means, which is adapted to be connected to a cable.

* * * * *